United States Patent [19]

Ollinger et al.

[11] Patent Number: 4,598,010

[45] Date of Patent: Jul. 1, 1986

[54] METHOD OF ATTACHING A METAL COVERING TO A CEILING BOARD

[75] Inventors: James C. Ollinger; Melvin H. Shaub, both of Lancaster, Pa.

[73] Assignee: Armstrong World Industries, Inc., Lancaster, Pa.

[21] Appl. No.: 750,120

[22] Filed: Jul. 1, 1985

[51] Int. Cl.[4] ..... E04B 1/84; B32B 3/04

[52] U.S. Cl. ..... 428/172; 52/144; 52/145; 181/284; 181/290; 428/163; 428/167; 428/192

[58] Field of Search ..... 428/167, 158, 163, 172, 428/192; 181/284, 288, 294, 290, 293; 52/145, 144

[56] References Cited

U.S. PATENT DOCUMENTS

| | | | |
|---|---|---|---|
| 1,998,425 | 4/1935 | McNeil | 52/145 |
| 2,073,735 | 3/1937 | Duffy | 52/410 |
| 2,101,612 | 12/1937 | Duffy | 52/468 |
| 2,497,912 | 2/1950 | Rees | 52/511 |
| 3,021,915 | 2/1962 | Kemp | 181/290 |
| 3,509,671 | 5/1970 | Akerson | 181/293 |
| 3,656,577 | 4/1972 | Larsson et al. | 52/145 |
| 3,695,395 | 10/1972 | Ollinger et al. | 181/290 |

*Primary Examiner*—Paul J. Thibodeau

[57] ABSTRACT

An acoustical ceiling tile is provided with a metal facing sheet covering at least one raised rib on the surface of the acoustical tile. The raised rib has two parallel sides and the facing sheet is made with two parallel edges having the ends thereof spaced apart a distance slightly less than the rib width. Consequently, the edges of the facing sheet will engage the edges of the rib and frictionally hold the facing sheet over the flat surface of the rib.

The above structure will permit humidity and temperature to cause fluctuation in the dimensions of the base sheet containing the raised rib without resulting in any distortion of the metal facing sheet.

2 Claims, 3 Drawing Figures

METHOD OF ATTACHING A METAL COVERING TO A CEILING BOARD

BACKGROUND OF THE INVENTION

1. Field of the Invention

The invention is directed to an acoustical ceiling tile which comprises a porous backing board having at least one raised rib and a metal covering for at least the facing surface of the raised rib.

2. Description of the Prior Art

U.S. Pat. No. 3,695,395 discloses a ceiling tile covered with a metal sheet. The metal sheet has its edges bent around the ceiling tile and the edges are held within a kerf of the ceiling tile.

U.S. Pat. No. 3,656,577 is similar in structure to the above-mentioned patent wherein the edges of the ceiling tile are engaged in the kerf of the ceiling board or are nailed, screwed, or glued to the edge of a ceiling board.

U.S. Pat. No. 2,073,735 discloses another building structure with a metal covering that has its edges engage a groove in its underlying structure.

U.S. Pat. No. 3,021,915 discloses a metal ceiling panel with a sound absorbing center and the metal on both sides of the sound absorbing material form an interlocking relationship.

U.S. Pat. No. 2,101,612 discloses a metal facing structure that covers the front face of a panel and engages the back edge of the panel to hold itself in position.

Finally, U.S. Pat. No. 1,998,425 discloses a metal acoustical structure that engages a support structure.

It is noted that none of the references above utilizes simply a friction feature to have a metal covering engage the side walls of an underlying structure to hold the metal covering in position.

SUMMARY OF THE INVENTION

The invention is directed to an acoustical tile which comprises a combination of at least one metal facing sheet and a porous backing board behind said sheet. The porous backing board has at least one raised rib forming a large smooth surface with at least two parallel straight sided walls on two opposite sides of said large smooth surface. The facing sheet is sufficient to cover the large smooth surface and it has at least one dimension approximately equal to the dimension of the porous backing board between the two vertical side walls. The facing sheet has two sides extending therefrom. The sides of the facing sheet are bent so that the dimension between the two sides adjacent its large smooth surface is about equal to the dimension of the smooth surface of the raised rib. However, the ends of the two sides are spaced apart less than the dimension of the large smooth surface of the raised rib. The metal facing sheet is positioned adjacent said large smooth surface with the vertical sides of the metal facing sheet resting against the vertical sides walls of only one rib of the porous backing sheet and due to the shaping of the side walls and their dimensional spacing, the side walls of the metal sheet will hold the facing sheet on the porous backing board by frictional contact between the side walls of the metal facing sheet and the side walls of the porous backing board.

Using any other type of positive fastening means of the metal facing to the backing board will cause the development of stresses and even wrinkling of the metal as the porous backing board expands and contracts with temperature and humidity. By using the frictional engagement between the facing sheet and the backing board, there can be dimensional changes within the backing board without loss of the frictional grip of the facing sheet to the backing board. Consequently, no stresses are developed in the interface between the facing sheet and the backing board and no wrinkling is caused to the facing sheet structure.

DESCRIPTION OF THE PREFERRED EMBODIMENT

Figure 1:
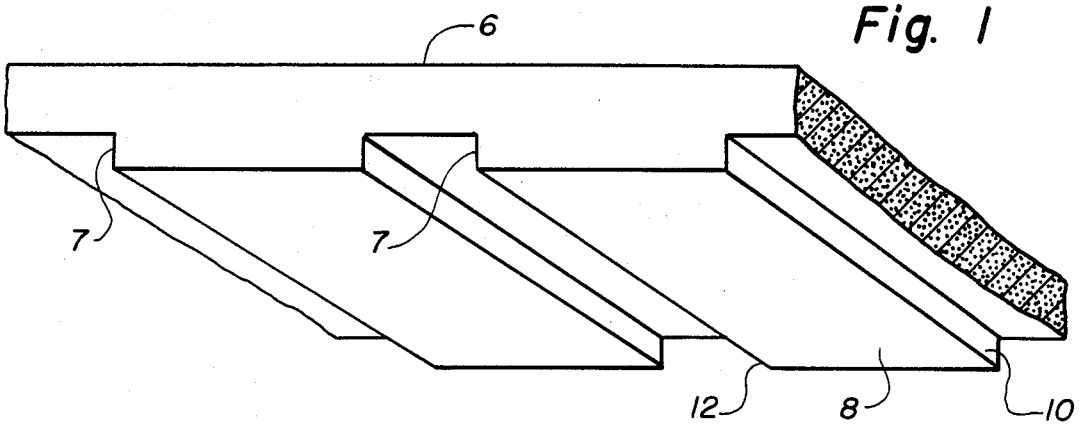
FIG. 1 is a prospective view of an acoustical porous backing board.
Figure 2:
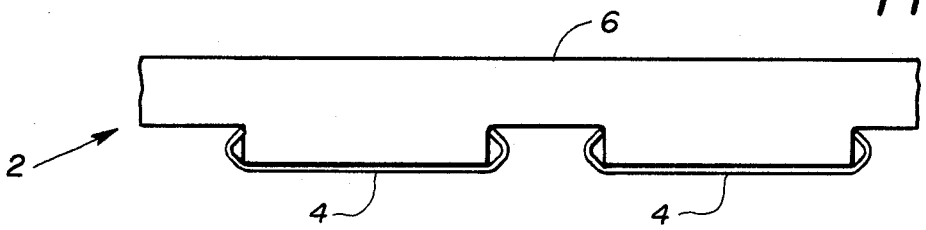
FIG. 2 is an end view of the acoustical tile of the invention herein.
Figure 3:
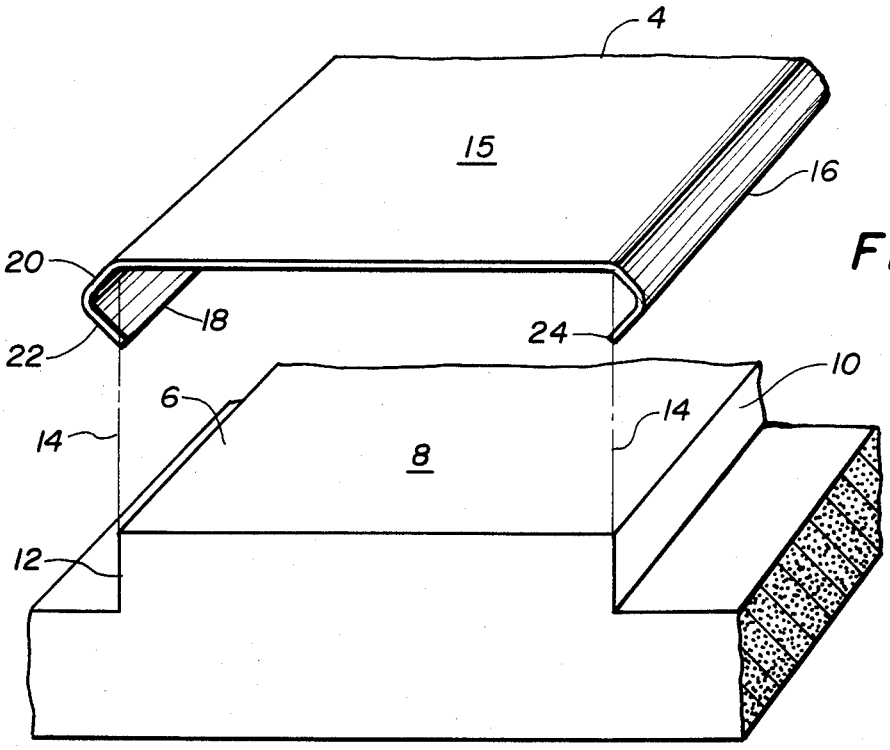
FIG. 3 is an exploded view of the facing sheet and porous backing board forming the acoustical tile of the invention herein.

An acoustical tile 2, as shown in FIG. 2, is formed from the combination of at least one metal facing sheet 4 and a porous backing board 6. The porous backing board is the same or is comparable to the porous backing board structure disclosed in U.S. Pat. No. 3,695,395. This product is basically a water laid mineral fiber product. The porous backing board of FIG. 1 has at least one raised rib 7 and this raised rib 7 has a large smooth surface 8 as shown in FIG. 3 with at least two parallel straight sided edges 10 and 12 on two opposite sides of said large smooth surface. The ribs are provided on the ceiling board to provide it with a linear effect which gives the impression of the decorative surface of the ceiling board being composed of a number of parallel ribs. The facing sheet must be of sufficient size to cover the large smooth surface 8 and provide a decorative covering therefore. As shown in FIG. 3, there is a dotted line structure 14 extending from the large smooth surface 15 of the facing sheet 4 and the dimension from dotted line 14 to dotted line 14 is approximately equal to the dimension of the large smooth surface 8 on the porous board 6 shown in Figure 3. In effect, smooth surface 15 and smooth surface 8 correspond in width as shown in FIG. 3 and, of course, they both will be of an indeterminate length depending on the size of the board and their length would also match up. The facing sheet has two sides 16 and 18 which extend therefrom. Each side is composed of an outwardly extending member 20 and an inwardly extending member 22. The ends of member 22 which are shown as 24 in FIG. 3 are spaced apart from each other less than the distance between the two dotted lines 14. Consequently, the distance between ends 24 is less than the width of the raised rib. The metal facing sheet is positioned adjacent the large smooth surface 8 of the porous backing board as shown in FIG. 2 and the vertical sides of the metal facing sheet rest against the vertical side walls of the porous backing board. The facing sheet is held to the porous backing board by frictional contact between the side walls of the metal facing sheet and the side walls of the porous backing board. This frictional contact exists and is maintained because the spacing of the ends 24 of the sides 16 and 18 of the facing sheet are closer together than the vertical sides 10 and 12 of the raised rib 7.

Acoustical ceiling boards notoriously are affected by moisture and temperature and this causes a change in their dimensions. Should the facing sheet be glued to the raised rib of the porous backing board, stresses could develop at the interface between the two and, if the board grows or shrinks, the ends bend downward or upward causing warping. Grooving the side walls of the rib 7 would not be convenient because the structures are often made with ribs which are only approximately two inches wide and the spacing between the ribs may be as small as 9/16 inch. Consequently, it would be difficult to cut the appropriate grooves into the side walls of the raised rib and, even if space was available for the cutting, the cost of cutting the grooves would make the product prohibited in cost.

Consequently, it has been found that the above described frictional contact creates a product where the facing sheet can be readily snapped onto the raised rib and will retain its position without the development of any stresses between the facing sheet and the porous backing board which could cause adverse visual effects in the finished product. The angled shape of each side of the facing sheet permits the ends 24 of the sides to grip the vertical side walls of the raised rib so that if external forces are applied to lift or remove the metal facing sheet from the raised rib, the ends 24 of the sides 16 and 18 are forced into the side walls of the raised rib preventing removal of the metal facing without destruction of the raised rib.

What is claimed is:

1. An acoustical tile comprising a combination of at least one metal facing sheet and a porous backing board behind said sheet, said porous backing board having at least one raised rib having a large smooth surface with at least two parallel straight sided walls on two opposite sides of said large smooth surface, said facing sheet being sufficient to cover the large smooth surface and having at least one dimension approximately equal to the dimension of the porous backing board between the two vertical side walls, said facing sheet having two sides extending therefrom, said metal facing sheet being positioned adjacent said large smooth surface with the vertical sides of the metal facing sheet resting against only the vertical side walls of one rib of the porous backing board and holding the metal facing sheet on the porous backing board by the frictional contact between the sides of the metal facing sheet and the side walls of one rib of the porous backing board so that if external forces are applied to lift or remove the metal facing sheet from the aforementioned raised rib, the ends of the sides of the metal facing sheet are forced into the side walls of the raised rib preventing removal of the metal facing without destruction of the raised rib, while at the same time, the metal facing sheet and backing board are free to move relative to each other as temperature and humidity cause changes in board dimensions.

2. The acoustical tile of claim 1 wherein each vertical side of the facing sheet is composed of a two-part structure, a first outwardly extending part and a second inwardly extending part, and the ends of the inwardly extending part of each opposite vertical side of the facing sheet being spaced apart from each other less than the distance between the two parallel straight sided walls of the raised rib, and said facing sheet is frictionally held on the raised rib without the assistance of an adhesive therebetween.

* * * * *